US005642810A

United States Patent [19]

Warner et al.

[11] Patent Number: 5,642,810

[45] Date of Patent: Jul. 1, 1997

[54] CONTAINER/DISPENSER FOR ROLLED PLASTIC BAGS

[75] Inventors: Rex Warner, Burnsville; Cyndi M. Meadows, Apple Valley; Dennis Shafer, Wayzata, all of Minn.

[73] Assignee: Carlisle Plastics, Inc., Phoenix, Ariz.

[21] Appl. No.: 582,108

[22] Filed: Jan. 2, 1996

[51] Int. Cl.[6] ..... B65D 85/66

[52] U.S. Cl. ..... 206/389; 206/409; 206/461; 220/4.23; 220/4.24

[58] Field of Search ..... 206/484, 461, 206/471, 459.5, 409, 389; 220/4.23, 4.24, 4.25, 628, 635, 665

[56] References Cited

U.S. PATENT DOCUMENTS

| | | | |
|---|---|---|---|
| D. 155,271 | 9/1949 | Collard et al. . | |
| D. 290,074 | 6/1987 | Braun . | |
| D. 329,978 | 10/1992 | Ryan . | |
| D. 332,916 | 2/1993 | Barnskog . | |
| D. 335,242 | 5/1993 | Saunders . | |
| 825,078 | 7/1906 | Schoen . | |
| 1,332,386 | 3/1920 | Dwyer . | |
| 1,924,823 | 8/1933 | Willi . | |
| 2,276,414 | 3/1942 | Morehouse et al. . | |
| 2,774,470 | 12/1956 | Q'Part . | |
| 3,128,025 | 4/1964 | Buttery et al. . | |
| 3,283,992 | 11/1966 | Hanson et al. . | |
| 3,511,433 | 5/1970 | Andrews et al. . | |
| 3,616,943 | 11/1971 | Brink . | |
| 3,786,982 | 1/1974 | Rakes et al. . | |
| 3,893,609 | 7/1975 | Jamois et al. . | |
| 3,937,514 | 2/1976 | Langowski | 294/88 |
| 4,034,926 | 7/1977 | Wegner . | |
| 4,139,093 | 2/1979 | Holmes . | |
| 4,191,307 | 3/1980 | LeCaire, Jr. . | |
| 4,384,664 | 5/1983 | Roos . | |
| 4,566,607 | 1/1986 | Smith . | |
| 4,576,330 | 3/1986 | Schepp . | |
| 4,627,514 | 12/1986 | Brown | 180/287 |
| 4,739,922 | 4/1988 | Zimmerman . | |
| 4,805,765 | 2/1989 | Barrett et al. . | |
| 4,850,486 | 7/1989 | Neibaur . | |
| 5,139,173 | 8/1992 | Evinger . | |
| 5,176,272 | 1/1993 | Ryan . | |

OTHER PUBLICATIONS

Visual Merchandising & Store Design, Oct. 1983, p. 64, Item 267.

Packaging Catalog, 1941, p. 47, Folding Dispensers.

*Primary Examiner*—Bryon P. Gehman
*Assistant Examiner*—Shian Lam
*Attorney, Agent, or Firm*—Emrich & Dithmar

[57] ABSTRACT

A package for plastic bags in a roll includes a container/dispenser in the general form of an upright cylinder of clear semi-rigid plastic having two halves hinged about a diametrical edge at the bottom of the container. Feet are formed in the bottom wall, extending transverse to the hinge and cooperating with the hinge to provide a base support so that the package may be stored and displayed in an upright position. An elongated recess is formed in the cylindrical wall of the container, with a die-cut strip. Bags may be dispensed through the opening formed when the strip is removed. A printed insert is located inside the clear sidewall of the containers for displaying product and brand identification information to the consumer.

5 Claims, 1 Drawing Sheet

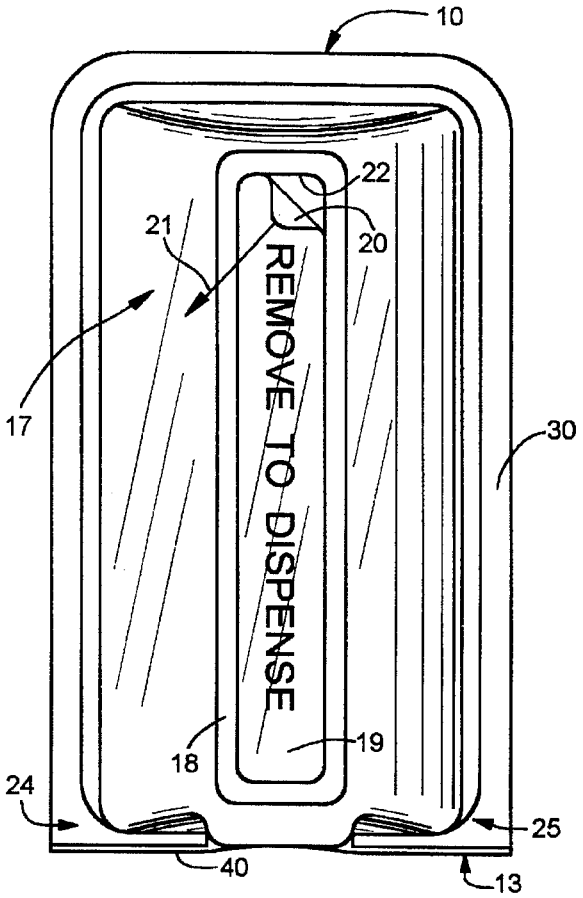
FIG. 1
FIG. 2
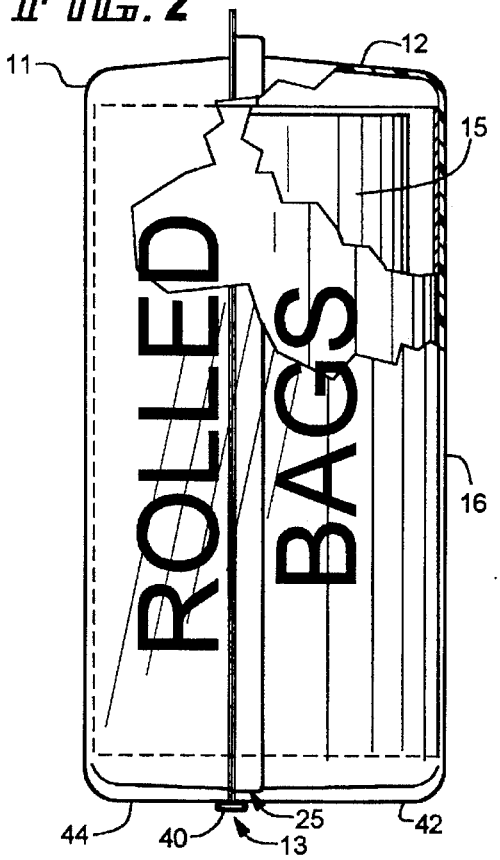
FIG. 3
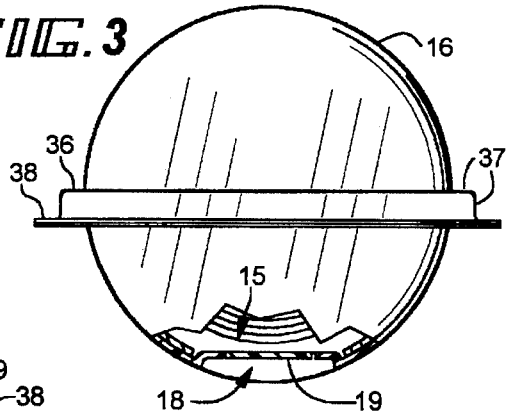
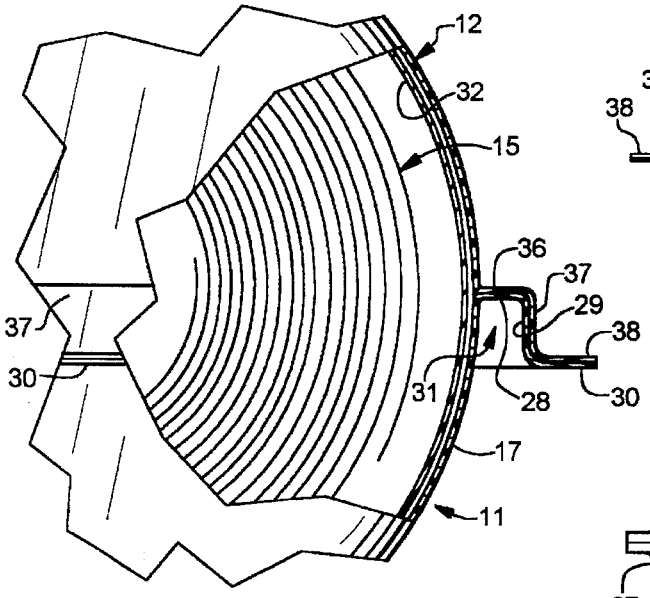
FIG. 4
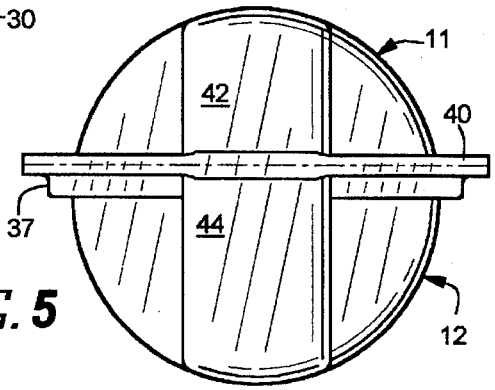
FIG. 5

CONTAINER/DISPENSER FOR ROLLED PLASTIC BAGS

FIELD OF THE INVENTION

The present invention relates to a package for plastic bags on a roll. In particular, it relates to a package for rolled plastic bags which permits the roll of bags to be supported on end for display and consumer access.

BACKGROUND OF THE INVENTION

The present invention relates to a container for use in storing and dispensing articles such as plastic bags formed in a spool or roll is disclosed in U.S. Pat. No. 5,176,272. The structure shown in this patent includes a transparent, semi-rigid container in the general form of a cylinder having an upper half and a lower half hinged about a horizontal line parallel to the axis of the roll in the container, thus forming a "clam shell" structure. This package is designed to rest on its side—that is, on the cylindrical sidewall of the container. To provide stability so that the cylindrical container does not roll off a shelf, a portion of the sidewall is flat and formed into a corrugated base on which the container rests on a shelf or the like. Moreover, the container includes an extension of a flange opposite the hinge for the two container sections. The flange extension is designed to engage the surface on which the package rests for stability. This package also includes upper rest surfaces which are corrugated and which are designed to receive the lower corrugated surface of a similar container stacked on top of a lower one. Thus, they are intended to be stacked, with the rolls disposed on their sides.

These containers are not widely used commercially because they are inefficient in the usage of valuable display space in a retail store. Moreover, although these containers are designed to be stacked, because of the smooth, semi-ridged plastic of the container sidewalls, and because of the structure of the design intended to permit one container to be stacked on top of another, there is a tendency to have the upper containers fall off of a lower one, as a consumer engages one package for removal from a stack or attempts to replace it in the stack after viewing it.

Another disadvantage of this type of container is that it is expensive to manufacture. It is also somewhat inefficient in space usage if the consumer intends to store it on a shelf at home because it is designed to rest on its side.

Finally, this type of container, which dispenses between flanges formed in the opposing sides of the cylindrical container, may open during dispensing because of the manner in which bags are pulled from the package. And if the product is the type of plastic trash bag which requires ties to be included in the package, the two sides of the container must be opened in order to retrieve a tie. Then the container must be re-closed after a tie is removed. In short, this type of container is expensive, is disadvantageous to the retailer because it is difficult to stack, not stable in stacking and inefficient in the utilization of shelf space. It is not particularly desirable from the standpoint of a consumer, either.

Another design for a container of this general type is disclosed in U.S. application Ser. No. 29/024,622, now abandoned. This particular structure is too expensive to manufacture and it is difficult under normal manufacturing conditions to maintain the tolerances necessary to have this particular structure function reliably.

SUMMARY OF THE INVENTION

The present invention includes a container for plastic bags on a roll. The bags may be connected end-to-end, in which case adjacent bags are separated by a perforation line adjacent a seal line, or they may be overlapped wherein the trailing edge of an outer bag is tucked beneath the leading edge of an inner bag on the roll. These and other arrangements of rolled bags are contemplated within the scope of the present invention.

The container/dispenser is formed in the general shape of an upright cylinder. It is injection-molded or thermoformed from a clear, semi-ridged plastic into two halves or side sections which are hinged about a diametrical line at the bottom of the container. Thus, the container and its contents are designed to sit on a base of the container which corresponds to an end of the roll, with the axis of the roll in a vertical position and the cylindrical sidewall of the container also standing vertically.

This type of container has substantial advantages to the manufacturer, to the retailer and to the consumer. For the manufacturer, it is economical to produce the container/dispenser and to assemble the final package by inserting the roll and closing the two side sections of the container. The amount of product lost is reasonable.

To the retailer, it is advantageous because the retailer may then display the rolls vertically by placing a containers on end. There is no need to stack the packages vertically, yet the package is stable, unlike other methods wherein rolls of plastic bags are packaged in flexible sleeves similar to the bags themselves. Moreover, a printed label can be placed inside the container surrounding its contents. This label may contain product identification, brand identification, description and instructions for the consumer, bar-coded identification, where desired, and any other printed materials. This type of packaging is also desirable to the manufacturer because the manufacturer then does not have to print this type of material on the plastic container nor on the bags (which is difficult to properly position for ready consumer access) in all cases.

The package is also advantageous to the consumer/user because it may be stacked vertically in the case of shelving, or alternatively it may be placed in a drawer, depending on consumer's normal place of storage.

Moreover, the container includes a removable die-cut strip extending substantially the entire length of the cylindrical sidewall and forming a dispenser opening. Not only may the bags be dispensed through this opening, but the dispenser opening is wide enough to permit the consumer to have access to the interior of the package to retrieve ties where available, without having to open the container. This particular advantage has further ramifications for the manufacturer because with this structure the three side sections of the container which do not include the hinge may have a ridge or recess formed to provide a continuous peripheral interference fit between the two sides, making it more difficult to open the package and, thus, more secure in storage and under the somewhat rugged conditions of use normally encountered in products of this nature.

Other features and advantages of the present invention will be apparent to persons skilled in the art from the following detailed description of a preferred embodiment accompanied by the attached drawing wherein identical reference numerals will refer to like parts in the various views.

BRIEF DESCRIPTION OF THE DRAWING

FIG. 1 is a rear elevational view of a container/dispenser constructed according to the present invention;

FIG. 2 is a right side view of the container/dispenser shown in FIG. 1 with a portion of the container and a different portion of the label removed for viewing the contents;

FIG. 3 is a top view of the container/dispenser as seen in FIG. 1;

FIG. 4 is an enlarged, fragmentary view similar to FIG. 3 with a portion of the container broken away and shown in section to view the contents; and FIG. 5. is a bottom view of the container/dispenser shown in FIG. 1.

DETAILED DESCRIPTION OF THE PREFERRED EMBODIMENT

Referring first to FIG. 1, reference numeral 10 generally designates a container having a first half section 11 and a second half section 12 (FIG. 2) joined by a hinge generally designated 13 to form an upright, cylindrical container for a roll or spool of bags 15 housed within the container.

The container may be manufactured either by injection molding or thermoforming from a clear plastic material which is semi-rigid in final form, such as clear polyethylene terephthalate having a thickness nominally in the range of 15 mils or polyurethane.

Turning now to the side section 11, it includes a cylindrical wall portion 17 at the center of which there is a recess 18. The recess 18 is formed axially of the cylindrical wall 17, and at the center of the recess 18 there is a die-cut removable strip 19. The strip 19 may be removed by loosening then prying up a corner such as designated at 20 in the drawing and moving that corner in the direction of the arrow 21 to tear the strip 19. The strip 19 may then be discarded, and the remaining aperture 22 becomes a slot through which the individual bags 15 may be removed from the container. The slot 22 is also wide enough to permit access into the interior of the container to remove ties for the bags, in the case where ties are provided. In this way, the nuisance of losing ties in the cases where ties must be removed from the container for use is obviated.

At the periphery of both upright sides of the cylindrical wall 17, as well as at the top thereof, that is, from the region generally designated 24 in FIG. 1, vertically upwardly and then surround the top and back down through the region generally designated 25 in FIG. 1, there is formed a flange structure shown in more detail in FIG. 4. In general, the flange on one section forms a tongue or male portion, and the flange on the other section forms a groove or cavity. The flange structure of the illustrated embodiment includes an outwardly extending portion 28, a rearwardly extending section 29 and then a second outwardly extending portion 30. The flange segments 28 and 29, together with the adjacent portion of wall 17 form a tongue 31. As used herein, the view shown in FIG. 1 is assumed to be a rear view because, as will be describe further below, a frontal view is one which normally shows the full, unobstructed view of a label inserted in the package and generally designated 32 in FIG. 4.

Returning to the flange structure, the second cylindrical section 12 includes a similar flange comprising an outwardly extending leg 36, a rearwardly extending leg 37, and a distal leg or stiffener flange 38, again extending outwardly. Flange sections 36 and 37 form a partial groove for receiving the above-described tongue. The container is formed and dimensioned such that when the two side sections 11, 12 are placed together, there is an interference between the sections 29 and 37 although this interference extends from the area designated 24 in FIG. 1 around the sides and upper portion of the container to the area designated 25, the holding power is most prominent at the top because the top portion of the tongue is captured at both ends and may be sized to increase the interference. This provides a substantial frictional engagement between the flanges of the two side sections and, once they are assembled together, the structure provides a fairly secure package container which is difficult to open accidentally, although it may be opened with some effort, if needed.

The label 32 may extend from one vertical side of the dispenser recess 18, circumferentially about the roll 15 inside the container, and around to the other side of the dispensing slot. Preferably, the label does not pass or obstruct the dispensing recess or the slot formed therein.

Thus, the label may contain printed materials such as a description of the product, source or brand identification, instructions, the size and number of bags contained in the roll, and any other material, such as bar-coded labels, desired by the retailer to be placed on the container. In this manner, the labels can be changed or used for different brands or numbers of bags, while using the same structure of container.

As seen in FIGS. 2 and 3, the top surfaces of the semi-cylindrical side sections 11, 12 are flat and inclined slightly upwardly and inwardly.

Turning now to FIGS. 1, 2 and 5, the hinge structure 13 and the support base on the bottom of the container will now be described. Preferably, the container is formed as an integral structure using conventional techniques, such as vacuum forming out of continuous plastic sheet. In the mold, of course, the two side sections 11, 12 extend in opposite directions from the hinge, and the two peripheral, outer flanges, 30, 38 extend generally in the same plane when the container is taken from the mold. The hinge 13 includes a web or backing 40 which is displaced slightly from the plane of flanges 30, 38, and on the opposite side of that plane from the direction in which the two sections fold to form a closed container, like the backing of a book. When the tongue 31 is forced into the cavity defined by the flange of the side section 12, the hinge 13, being somewhat flexible, permits a close, interference fit, but the hinge also provides a biasing force urging the top portion of the tongue into engagement with the top portion of the retaining cavity formed by legs 36 and 37.

The bottom wall of the side section 12 of the container is formed into a foot designated 42 and best seen in FIG. 5. The foot 42 extends from the hinge 40 outwardly to the edge of the cylindrical sidewall, and the lower surface of the foot 42 is generally in the same plane as the web 40 of the hinge 13. A similar foot 44 is formed in the bottom wall of the side section 11, and its lower surface similarly is in the same general plane as the web 40. The bottoms of the two feet 42, 44 extend crosswise to the web 40 and provide a stable base for resting the container and contents in a vertical position, such as seen in FIGS. 1 and 2, which is the normal storage and display position for the container and its contents, particularly on consumer shelves because in that position, the container efficiently utilizes shelf space without having to be stacked vertically.

Moreover, the label or insert 15 is readily viewed, unobstructed, through the continuous cylindrical sidewall 16 of the container section 12.

Having thus disclosed in detail a preferred embodiment of the invention, persons skilled in the art will be able to substitute equivalent elements for those disclosed and to modify certain of the structure which has been illustrated while continuing to practice the principle of the invention; and it is, therefore, intended that all such modifications and substitutions be covered as they are embraced within the spirit and scope of the appended claims.

I claim:

1. A package comprising:

a container of clear plastic formed into first and second side sections, each having a top wall, a cylindrical side wall and a bottom wall;

a hinge interconnecting said bottom walls of said side sections;

one of said side sections defining an elongated removable strip to form a dispensing opening when said strip is removed, said side sections forming interlocking portions maintaining said side sections in closed relation to form a cylindrical container, said bottom walls each forming a foot outwardly of said hinge, said hinge and each foot cooperating to form a base for supporting said container in an upright position on a flat shelf;

a plurality of flexible, flat items in a roll inside said container; and a sheet insert bearing printed matter between said roll and said cylindrical side wall of at least one of said side sections.

2. The package of claim 1 wherein each of said side sections includes a generally cylindrical sidewall and a peripheral flange, the peripheral flange of one side section engaging the corresponding peripheral flange of the other side section, said peripheral flanges extending on three sides of said container except for said hinge side, one of said peripheral flanges forming a tongue, and the other of said peripheral flanges forming a cavity for said tongue.

3. The apparatus of claim 1 wherein each foot extends below the associated bottom wall of a section and having a bottom surface extending substantially in the same horizontal plane as said hinge, said each foot extends crosswise of said hinge.

4. The apparatus of claim 1 wherein the cylindrical sidewall of one of said side sections defines an axially elongated recess extending substantially the entire height of said container sidewall and spaced equally distant from said flanges, and a die-cut portion forming said removable strip in said recess.

5. The article of claim 4 wherein the width of said strip is sufficient such that when said strip is removed, a user may gain access to the interior of said package with one's fingers to locate and remove the free edges of an outer bag on said roll or to gain access to ties within said package.

* * * * *